US005947290A

United States Patent [19]

Loeschen

[11] Patent Number: 5,947,290

[45] Date of Patent: Sep. 7, 1999

[54] SCORED U-SHAPED PACKAGING MEMBERS

[75] Inventor: Michael D. Loeschen, Evanston, Ill.

[73] Assignee: Illinois Tool Works Inc., Glenview, Ill.

[21] Appl. No.: 09/119,198

[22] Filed: Jul. 20, 1998

[51] Int. Cl.[6] ..... B65D 85/48

[52] U.S. Cl. ..... 206/453; 206/592; 206/517

[58] Field of Search ..... 206/453, 485, 206/486, 591, 592, 454, 449, 505, 515, 517, 519

[56] References Cited

U.S. PATENT DOCUMENTS

| | | | |
|---|---|---|---|
| 1,138,290 | 5/1915 | Heimbuecher . | |
| 1,758,230 | 5/1930 | Lange . | |
| 2,194,669 | 3/1940 | Mumford . | |
| 2,319,641 | 5/1943 | Speir, Jr. . | |
| 2,344,852 | 3/1944 | Esposito . | |
| 2,588,232 | 3/1952 | Grant . | |
| 2,938,623 | 5/1960 | Eichorn . | |
| 3,007,622 | 11/1961 | George . | |
| 3,041,717 | 7/1962 | Brown . | |
| 3,335,932 | 8/1967 | Brown | 206/586 |
| 3,370,777 | 2/1968 | Levi . | |
| 3,503,550 | 3/1970 | Main et al. | 206/592 |
| 3,543,994 | 12/1970 | Clark . | |
| 3,669,338 | 6/1972 | Cornell et al. . | |
| 3,718,275 | 2/1973 | Willinger | 206/592 |
| 3,759,193 | 9/1973 | Branch . | |
| 4,087,041 | 5/1978 | Centanni . | |
| 4,157,138 | 6/1979 | Duncan . | |
| 4,349,124 | 9/1982 | Faller . | |
| 4,477,015 | 10/1984 | Lozaun . | |
| 4,693,413 | 9/1987 | McFarland et al. . | |
| 4,784,270 | 11/1988 | Layer et al. | 206/586 |
| 4,976,374 | 12/1990 | Macaluso . | |
| 5,048,689 | 9/1991 | McFarland | 206/586 |
| 5,328,033 | 7/1994 | Ptaschinski . | |
| 5,413,053 | 5/1995 | Vannatta . | |
| 5,423,270 | 6/1995 | Kilpatrick et al. . | |
| 5,427,034 | 6/1995 | Kilpatrick et al. . | |
| 5,490,465 | 2/1996 | Hoyt et al. . | |
| 5,503,085 | 4/1996 | Rozek . | |
| 5,711,426 | 1/1998 | Kuhn et al. . | |

FOREIGN PATENT DOCUMENTS

| | | |
|---|---|---|
| 697675 | 11/1964 | Canada . |
| 0 020 171 | 12/1980 | European Pat. Off. . |
| 808228 | 2/1937 | France . |
| 1186056 | 8/1959 | France . |
| 1217887 | 5/1960 | France . |
| 2 498 561 | 1/1981 | France . |
| 184097 | 8/1922 | United Kingdom . |

*Primary Examiner*—Paul T. Sewell
*Assistant Examiner*—Nhan T. Lan
*Attorney, Agent, or Firm*—Schwartz & Weinrieb

[57] ABSTRACT

A packaging member comprises a base member and a pair of side members hingedly attached to opposite sides of the base member such that the side members can be alternatively and selectively disposed in two different positions with respect to the base member. In particular, the side members can be disposed perpendicular to the base member, or alternatively the side members can be disposed at predetermined angled positions with respect to the base member. When disposed perpendicularly to the base member, the packaging member has a substantially U-shaped configuration enabling the packaging member to serve as an edge protector, whereas when the side members are disposed at their angled positions with respect to the base member, the packaging member has a substantially trapezoidal configuration enabling stacking or nesting of the packaging member along with other similar packaging members so as to optimize storage, shipping, and handling or transportation costs.

20 Claims, 1 Drawing Sheet

SCORED U-SHAPED PACKAGING MEMBERS

FIELD OF THE INVENTION

The present invention relates generally to packaging members, and more particularly to packaging members which serve as article edge protectors for protecting the edge regions of substantially flat articles or planar articles having, nevertheless, substantial thickness and length dimensions, such as, for example, garage doors, plate glass members, and the like.

BACKGROUND OF THE INVENTION

Substantially flat articles having substantial thickness and length dimensions, such as, for example, plate glass members, garage doors, and the like, need to have their edge regions protected during, for example, transportation and shipping thereof from their manufacturing facilities to their storage and/or point of sale locations so as to prevent damage from occurring to such edge regions prior to the purchase of such articles by consumers. It is conventional practice to utilize substantially rigid, laminated U-shaped channel members as edge protectors whereby the U-shaped channel members are mounted upon the edge regions of the articles and secured thereto by, for example, suitable strapping. One type of conventional edge protector which has been used for the foregoing purposes has been derived from the packing container which is disclosed within U.S. Pat. No. 4,976,374 which issued to Macaluso on Dec. 11, 1990.

More particularly, while the aforenoted patent is directed toward a composite packing container which is used to package elongated articles and is seen to comprise a substantially U-shaped base unit 10 and a substantially U-shaped cover unit 12 which are mated together and secured by means of strapping bands 16 as best seen in FIG. 3, the individual base units 10 and cover units 12 have been employed in the packaging industry as edge protectors so as to protect the edge regions of, for example, substantially flat articles having substantial length and thickness dimensions. It is noted, however, that the base units 10 and the cover units 12 are substantially rigid and inflexible. In addition, when produced in accordance with mass-production techniques, while each base unit 10 will differ in size, for example, from each cover unit 12 so as to permit the interfitting or assembly of the respective base units 10 and the cover units 12 as shown in FIG. 3, all of the base units 10 will be of the same size with respect to each other and all of the cover units 12 will be of the same size with respect to each other. Consequently, neither the base units 10 nor the cover units 12 can be nested together in a stack so as to facilitate the economical shipping or transportation thereof in a manner which optimizes shipping, cargo, or transportation space and costs.

A need therefore exists in the packaging art for a substantially U-shaped packaging member which can be utilized as an edge protector so as to protect the edge regions of substantially flat articles having substantial length and thickness dimensions, and wherein such edge protectors are uniquely structured so as to nevertheless permit or facilitate the nesting or stacking of a plurality of such edge protectors in order to optimize shipping, cargo, or transportation space and costs. In particular, a need exists in the packaging art for a substantially U-shaped packaging member which can be utilized as an edge protector which, in effect, has different structural orientations, dispositions, configurations, or modes whereby when, for example, the edge protector is disposed within a first mode or configuration, the edge protector can in fact perform its function as an edge protector, whereas when the edge protector is disposed within a second mode or configuration, the edge protector can be readily stacked along with other similar edge protectors for shipping and transportation purposes.

OBJECTS OF THE INVENTION

Accordingly, it is an object of the present invention invention to provide a new and improved substantially U-shaped packaging member which can be utilized as an edge protector for protecting the edge regions of substantially flat articles having substantial length and thickness dimensions.

Another object of the present invention is to provide a new and improved substantially U-shaped packaging member which can be utilized as an edge protector for protecting the edge regions of substantially flat articles having substantial length and thickness dimensions wherein such edge protectors are uniquely structured so as to permit or facilitate the nesting or stacking of a plurality of such edge protectors in order to economically optimize shipping, cargo and transportation space requirements and costs.

A further object of the present invention is to provide a new and improved substantially U-shaped packaging member which can be utilized as an edge protector for protecting the edge regions of substantially flat articles having substantial length and thickness dimensions wherein such edge protectors are uniquely structure so as to be capable of being disposed within a first mode, configuration, or orientation whereby the edge protector can in fact perform its function as an edge protector so as to protect the edge regions of articles, and wherein further, such edge protectors are capable of being disposed within a second mode, configuration, or orientation so as to permit or facilitate the nesting or stacking of such edge protectors during shipping and transportation thereof.

SUMMARY OF THE INVENTION

The foregoing and other objects are achieved in accordance with the teachings of the present invention through the provision of a packaging member which comprises a laminated paperboard component. The component has a substantially trapezoidal configuration with the longer base member or side omitted whereby the three remaining sides of the trapezoid define a substantially inverted U-shaped component with angled sides. Score lines or means are defined at the junctions of the angled sides and the upper base member, and in this manner, the sides of the packaging member are movable with respect to the upper base member. As a result of such movability of the sides of the packaging member with respect to the upper base member of the packaging member, the sides of the packaging member can be moved relative to the upper base member of the packaging member so as to be disposed at substantially 90° with respect to the upper base member of the packaging member.

As a result of the foregoing structure, it is appreciated that the sides of the packaging member are disposable at two different positions with respect to the upper base member of the packaging member whereby the packaging member can attain two different modes or states in accordance with the present invention. More particularly, when the sides of the packaging member are disposed at the perpendicular or 90° positions with respect to the upper base member, the packaging member is able to serve as an edge protector for articles having substantial length and thickness dimensions when the packaging member is disposed around edge regions of such articles and secured thereto by means of, for example, suitable strapping. Alternatively, when the sides of the packaging member are disposed at their angled positions with respect to the upper base member, the packaging member can be nested or stacked along with a plurality of similarly configured packaging members so as to facilitate the shipping and transportation of such packaging members in an economically optimal manner.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
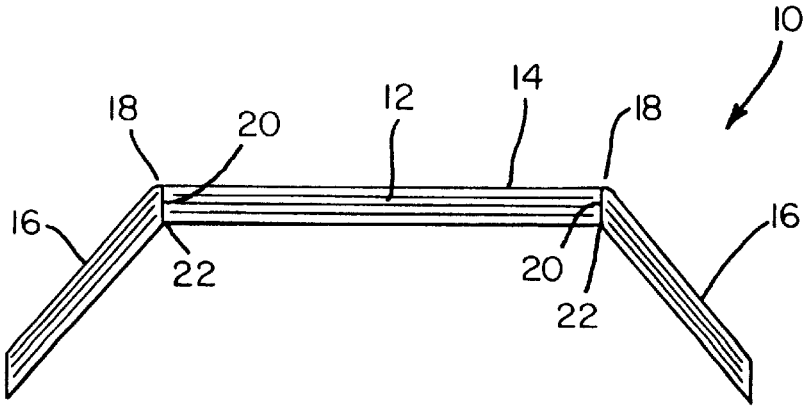
FIG. 3 is an end elevation view of the packaging member shown in FIG. 1 illustrating the details of the packaging member, particularly the scoring of the same at the junctions defined between the sides of the packaging member and the upper base member thereof so as to permit the packaging member to selectively attain the two different modes or states respectively required for its use as an edge protector, or alternatively, to permit the packaging members to be nested or stacked for transportation or shipping purposes.

Referring now to the drawings, and more particularly and firstly to FIG. 3 thereof, the new and improved packaging member constructed in accordance with the teachings of the present invention is disclosed and generally indicated by the reference character 10. As can be appreciated from FIG. 3, the packaging member 10 comprises a substantially rigid structure comprising a laminated paperboard component which is fabricated from a plurality of paperboard plies 12. The packaging member 10 has a substantially trapezoidal configuration from which the normally present lower or larger base member has been omitted. More particularly, the packaging member 10 is seen to comprise an upper base member 14 and a pair of side members 16,16 which are angled downwardly and outwardly from the upper base member 14 at a predetermined angle, such as, for example, approximately 50°.

In addition to the foregoing structural components or characteristics of each one of the packaging members 10 constructed in accordance with the teachings of the present invention as noted hereinabove, it is further appreciated that each one of the corner junctions 18,18 of the packaging members 10, as defined between each one of the side members 16 of the packaging member 10 and the upper base member 14, is scored or slit as at 20, 20 in such a manner that only the lowermost ones of the paper plies 12 remain intact. In this manner, integral or living hinges 22,22 are defined upon the packaging member 10 whereby the side members 16,16 of the packaging member 10 are capable of being moved in a pivotal manner with respect to the upper base member 14 between the angled positions shown in FIG. 3 and positions at which the side members 16,16 are disposed substantially perpendicular to the upper base member 14 as shown, for example, in FIG. 1.

Figure 1:
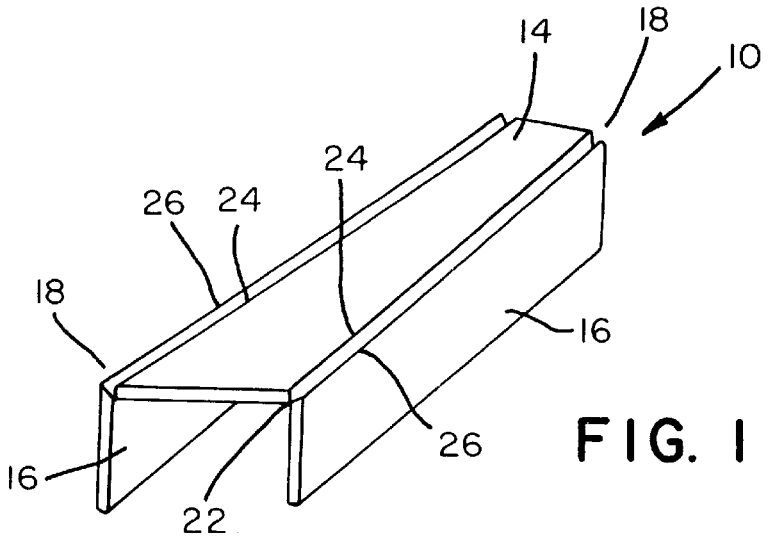
FIG. 1 is a schematic perspective view of a packaging member constructed in accordance with the teachings of the present invention and showing the sides of the packaging member disposed in a first mode or state with respect to the upper base member of the packaging member wherein the sides of the packaging member are disposed at substantially 90° with respect to the upper base member of the packaging member whereby the packaging member can serve as an edge protector for protecting edge regions of articles having substantial length and thickness dimensions when the edge protector is mounted and secured upon such articles.
Figure 2:
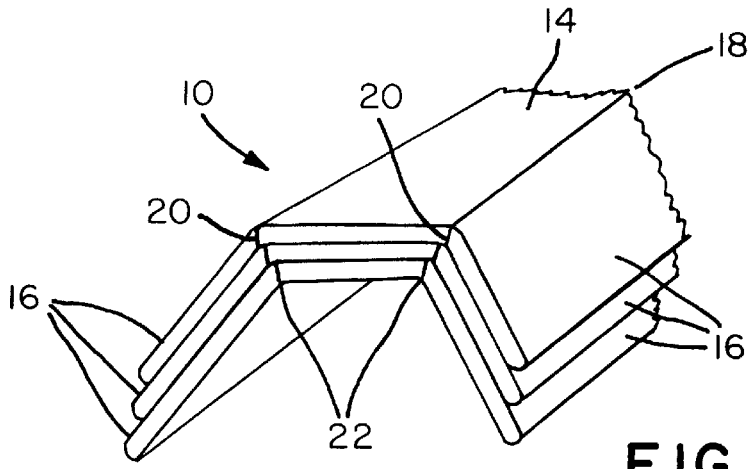
FIG. 2 is a schematic perspective view of a plurality of packaging members wherein each one of the packaging members is of the type shown in FIG. 1 and wherein the sides of the packaging member are disposed in a second mode or state with respect to the upper base member of the packaging member such that the sides of the packaging member are outwardly angled with respect to the upper base member of the packaging member so as to permit the nesting or stacking together of the plurality of packaging members so as to facilitate the shipping and transportation of the same in an economically optimized manner.

When the side members 16,16 are disposed in their substantially perpendicular mode or state with respect to the upper base member 14 as shown in FIG. 1, the packaging member 10 has a substantially inverted U-shaped configuration and is capable of being used as an edge protector for articles having substantial length and thickness dimensions as a result of the packaging member 10, as disposed in its mode or state illustrated in FIG. 1, being mounted upon an edge region of the article, not shown, and being secured thereon by, for example, suitable packaging strapping or the like, also not shown. When the side members 16,16 are disposed in their angled mode or state with respect to the upper base member 14 as shown in FIG. 3, the packaging members 10 are capable of being nested or stacked upon one another as shown in FIG. 2 whereby a plurality of such packaging members 10 can be stored, shipped or transported in an economically optimized manner.

With continued or additional reference being made to FIG. 1, it is appreciated that the scoring or slitting of the corner regions 18,18 of each packaging member 10 forms, in effect, two surfaces 24 and 26 which are respectively formed upon opposite sides of the upper base member 14 and each one of the side members 16 within the vicinity of each integral or living hinge member 22. When the side members 16 are therefore moved from their substantially perpendicular positions with respect to the upper base member 14 as shown in FIG. 1 to their angled positions with respect to the upper base member 14 as shown in FIGS. 2 and 3, the respective surfaces 24 and 26 of the upper base member 14 and the side members 16,16 will abut each other so as to, in effect, define the angled modes or states of the side members 16,16 with respect to the upper base member 14 as shown in FIGS. 2 and 3. In this manner, the plurality of packaging members 10 can in fact be nested or stacked upon or with respect to each other so as to facilitate the economical storage, shipping or transportation of the same.

Thus, it is seen that in accordance with the teachings of the present invention, there has been provided a new and improved packaging member which can be disposed in a first state or mode wherein side members of the packaging member are disposed substantially perpendicular to a base member of the packaging member whereby the packaging member has a substantially U-shaped configuration so as to permit the packaging member to be utilized as an edge protector in connection with the protection of edge regions of articles having substantial thickness and length dimensions. In addition, or alternatively, the packaging member can be disposed in a second state or mode wherein the side members of the packaging member are disposed at predetermined angles with respect to the base member of the packaging member whereby the packaging member has a substantially trapezoidal configuration so as to permit a plurality of packaging members to be economically nested or stacked upon one another during storage, shipping, or transportation operations.

Obviously, many modifications and variations of the present invention are possible in light of the above teachings. It is therefore to be understood that within the scope of the appended claims, the present invention can be practiced otherwise than as specifically described herein.

What is claimed as new and desired to be protected by Letters Patent of the United States of America, is:

1. A three-member, nestable, edge-protector packaging member for protecting edge regions of articles, comprising:

a substantially rigid base member having opposite sides;

a pair of substantially rigid side members; and means movably interconnecting said pair of substantially rigid side members to said opposite sides of said substantially rigid base member such that said pair of substantially rigid side members can be disposed in two different positions with respect to said substantially rigid base member whereby said packaging member attains two different states, said packaging member being disposed in a first one of said two different states and serving as a substantially U-shaped edge protector for protecting edge regions of an article, when said packaging member is mounted and secured upon an edge region of an article, as a result of each one of said pair of substantially rigid side members being disposed substantially perpendicular to said substantially rigid base member, and said packaging member being disposed in a second one of said two different states and having a substantially trapezoidal configuration so as to be permitted to be nested and stacked along with similar packaging members as a result of each one of said pair of substantially rigid side members being disposed at a predetermined angle with repsect to said substantially rigid base member.

2. The packaging member as set forth in claim 1, wherein:

said means movably interconnecting said pair of side members to said opposite sides of said base member comprise integral living hinges disposed at corner junctions of said packaging member and defined between said pair of side members and said opposite sides of said base member.

3. The packaging member as set forth in claim 2, wherein:

said pair of side members and said base member each have predetermined thickness dimensions; and said means movably interconnecting said pair of side members to said opposite sides of said base member comprise slits provided at said corner junctions defined between said pair of side members and said opposite sides of said base member and extend partially through the thickness of said pair of side members and said base member so as to maintain a portion of each one of said pair of side members integrally attached to a respective portion of each one of said opposite sides of said base member so as to thereby define said integral living hinges.

4. The packaging member as set forth in claim 1, wherein:

said base member and said pair of side members comprise paperboard laminates comprising a plurality of paperboard plies.

5. The packaging member as set forth in claim 4, wherein:

said means movably interconnecting said pair of side members to said opposite sides of said base member comprise integral living hinges disposed at corner junctions of said packaging member and defined between said pair of side members and said opposite sides of said base member.

6. The packaging member as set forth in claim 5, wherein:

said pair of laminated side members and said laminated base member each have predetermined thickness dimensions; and said means movably interconnecting said pair of side members to said opposite sides of said base member comprise slits provided at said corner junctions defined between said pair of laminated side members and said opposite sides of said laminated base member and extend through only some of said paperboard plies of said pair of laminated side members and said laminated base member so as to maintain remaining ones of said paperboard plies of said pair of laminated side members and said laminated base member intact and thereby define said integral living hinges.

7. The packaging member as set forth in claim 1, wherein:

said side members of said packaging member are disposed substantially perpendicular to said base member of said packaging member when said pair of side members are disposed at said first one of said two positions relative to said base member whereby said packaging member has a substantially U-shaped configuration enabling service of said packaging member as an edge protector for protecting edge regions of an article upon which said edge protector can be mounted and secured; and said side members of said packaging member are disposed at predetermined angled positions with respect to said base member of said packaging member when said pair of side members are disposed at said second one of said two positions relative to said base member whereby said packaging member has a substantially trapezoidal configuration enabling said packaging member to be nested and stacked along with similar packaging members.

8. The packaging member as set forth in claim 7, wherein:

said pair of side members are disposed at angles of approximately 50° with respect to said base member when said pair of side members are disposed at said second one of said two positions with respect to said base member.

9. A nested stack of a plurality of three-member, nestable, edge-protector packaging members for protecting edge regions of articles, comprising:

a plurality of substantially rigid base members respectively having pairs of opposite sides; and a pair of substantially rigid side members respectively movably interconnected to said pair of opposite sides of each one of said substantially rigid base members such that each one of said pair of substantially rigid side members can be respectively disposed in two different positions with respect to said substantially rigid base member to which said pair of substantially rigid side members are respectively connected whereby each one of said packaging members can attain two different states, each one of said packaging members being able to be disposed in a first one of said two different states and being able to serve as a substantially U-shaped edge protector for protecting edge regions of an article, when said packaging member is mounted and secured upon an edge region of an article, as a result of each one of said pair of substantially rigid side members being disposed substantially perpendicular to said substantially rigid base member, and wherein each one of said packaging members is able to be disposed in a second one of said two different states and has a substantially trapezoidal configuration so as to be capable of being nested and stacked along with other ones of said plurality of packaging members as a result of each one of said pair of substantially rigid side members being respectively disposed at a predetermined angle with respect to said substantially rigid base member to which said pair of substantially rigid side members are connected whereby each one of said plurality of packaging members has an expanded U-shaped, substantially trapezoidal configuration which permits said plurality of packaging members to be nested in a stacked relationship with respect to each other.

10. The packaging member as set forth in claim 9, wherein:

said pair of side members are movably interconnected to said opposite sides of said base member by integral living hinges disposed at corner junctions of said packaging member and defined between said pair of side members and said opposite sides of said base member.

11. The packaging member as set forth in claim 10, wherein:

said pair of side members and said base member each have predetermined thickness dimensions; and said means movably interconnecting said pair of side members to said opposite sides of said base member comprise slits provided at said corner junctions defined between said pair of side members and said opposite sides of said base member and extend partially through the thickness of said pair of side members and said base member so as to maintain a portion of each one of said pair of side members integrally attached to a respective portion of each one of said opposite sides of said base member so as to thereby define said integral living hinges.

12. The packaging member as set forth in claim 9, wherein:

said base member and said pair of side members comprise paperboard laminates comprising a plurality of paperboard plies.

13. The packaging member as set forth in claim 12, wherein:

said pair of side members are movably interconnected to said opposite sides of said base member by integral living hinges disposed at corner junctions of said packaging member and defined between said pair of side members and said opposite sides of said base member.

14. The packaging member as set forth in claim 13, wherein:

said pair of laminated side members and said laminated base member each have predetermined thickness dimensions; and said means movably interconnecting said pair of side members to said opposite sides of said base member comprise slits provided at said corner junctions defined between said pair of laminated side members and said opposite sides of said laminated base member and extend through only some of said paperboard plies of said pair of laminated side members and said laminated base member so as to maintain remaining ones of said paperboard plies of said pair of laminated side members and said laminated base member intact and thereby define said integral living hinges.

15. The packaging member as set forth in claim 9, wherein:

said side members of said packaging member are disposed substantially perpendicular to said base member of said packaging member when said pair of side members are disposed at said first one of said two positions relative to said base member whereby said packaging member has a substantially U-shaped configuration enabling service of said packaging member as an edge protector for protecting edge regions of an article upon which said edge protector can be mounted and secured; and said side members of said packaging member are disposed at predetermined angled positions with respect to said base member of said packaging member when said pair of side members are disposed at said second one of said two positions relative to said base member whereby said packaging member has a substantially trapezoidal configuration enabling said packaging member to be nested and stacked along with similar packaging members.

16. The packaging member as set forth in claim 15, wherein:

said pair of side members are disposed at angles of approximately 50° with respect to said base member when said pair of side members are disposed at said second one of said two positions with respect to said base member.

17. A method of forming a three-member, nestable, edge-protector packaging member for protecting edge regions of articles, comprising the steps of:

providing said packaging member with a substantially rigid base member having opposite sides;

providing said substantially rigid base member with a pair of substantially rigid side members attached to said substantially rigid base member along said opposite sides of said substantially rigid base member; and hingedly attaching said pair of substantially rigid side members to said opposite sides of said substantially rigid base member such that said pair of substantially rigid side members are pivotally movable between two different positions with respect to said substantially rigid base member whereby said packaging member attains two different states, said packaging member being disposed in a first one of said two different states and serving as a substantially U-shaped edge protector for protecting edge regions of an article, when said packaging member is mounted and secured upon an edge region of an article, as a result of each one of said pair of substantially rigid side members being disposed substantially perpendicular to said substantially rigid base member, and said packaging member being disposed in a second one of said two different states and having a substantially trapezoidal configuration so as to be capable of being nested and stacked along with similar packaging members as a result of each one of said pair of substantially rigid side members being disposed at a predetermined angle with respect to said substantially rigid base member.

18. The method as set forth in claim 17, further comprising the step of:

providing integral living hinges upon said packaging member at corner junctions of said packaging member as defined between said pair of side members and said opposite sides of said base member.

19. The method as set forth in claim 18, further comprising the steps of:

forming said pair of side members and said base member from laminated paperboard having a plurality of paperboard plies; and slitting said corner junctions of said packaging member such that only some of said paperboard plies of said pair of side members and said base member remain intact so as to define said integral living hinges.

20. The method as set forth in claim 17, further comprising the steps of:

disposing said side members of said packaging member at said first one of said two positions relative to said base member of said packaging member such that said side members are disposed substantially perpendicular to said base member of said packaging member whereby said packaging member has a substantially U-shaped configuration enabling service of said packaging member as an edge protector for protecting edge regions of an article upon which said edge protector can be mounted and secured; and disposing said side members of said packaging member at said second one of said two positions relative to said base member of said packaging member such that said side members are disposed at predetermined angled positions with respect to said base member of said packaging member whereby said packaging member has a substantially trapezoidal configuration enabling said packaging member to be nested and stacked along with similar packaging members.

* * * * *